US005538091A

United States Patent [19]

Theocharopoulos

[11] Patent Number: 5,538,091

[45] Date of Patent: Jul. 23, 1996

[54] BOTTOM HOLE ASSEMBLY

[75] Inventor: Nicholas Theocharopoulos, Philadelphia, Pa.

[73] Assignee: Schlumberger Technology Corporation, Sugar Land, Tex.

[21] Appl. No.: 318,457

[22] Filed: Oct. 5, 1994

[30] Foreign Application Priority Data

Oct. 5, 1993 [GB] United Kingdom ..... 9320435

[51] Int. Cl.[6] ..... E21B 7/04

[52] U.S. Cl. ..... 175/61; 175/325.3

[58] Field of Search ..... 175/398–400, 175/61, 325.3

[56] References Cited

U.S. PATENT DOCUMENTS

| | | |
|---|---|---|
| 3,637,032 | 1/1972 | Jeter . |
| 4,040,494 | 8/1977 | Kellner . |
| 4,291,773 | 9/1981 | Evans . |
| 4,461,359 | 7/1984 | Jones, Jr. et al. . |
| 4,637,479 | 1/1987 | Leising . |
| 4,714,118 | 12/1987 | Baker et al. . |
| 4,821,815 | 4/1989 | Baker et al. . |
| 4,836,301 | 6/1989 | Van Dongen et al. . |
| 4,867,255 | 9/1989 | Baker et al. . |
| 4,995,465 | 2/1991 | Beck et al. . |
| 5,009,272 | 4/1991 | Walter . |
| 5,320,179 | 6/1994 | Roos, Jr. et al. ..... 175/61 X |

FOREIGN PATENT DOCUMENTS

| | | |
|---|---|---|
| 2246151 | 1/1992 | United Kingdom . |
| WO90/05235 | 5/1990 | WIPO . |

OTHER PUBLICATIONS

Gerzhberg, Y. M. and V. D. Charkov, "Investigations of Bottom Hole Assemblies for Drilling Horizontal Wells by the Rotary Method", *IZV VYSSH UCHEB ZAVEDENIL NEFT GAZ*, No. 7 (Jul. 1988), pp. 23–28, [Petroleum Abstracts No. 463,285].

*Primary Examiner*—Michael Powell Buiz
*Attorney, Agent, or Firm*—Peter Y. Lee; Wayne I. Kanak

[57] ABSTRACT

The present invention provides a bottom hole assembly (BHA) for connection to a drillstring for use in directing the path of a drill bit while rotary drilling, the BHA comprising an apparatus for providing a modified cutting action of the bit in a predetermined portion of the hole, a stabilizer, and a flexible member interposed between the bit and the stabilizer. By "flexible" member is meant a member made from a material having a lower Young's modulus than steel and/or a member with a smaller wall thickness than the remainder of the BHA. In the case where the BHA is formed from steel pipe, a flexible member might be provided by an aluminum drill collar or a composite material drill collar. Alternatively or additionally, the wall thickness of the material from which the collar is formed can be made less than the remainder of the BHA.

21 Claims, 2 Drawing Sheets

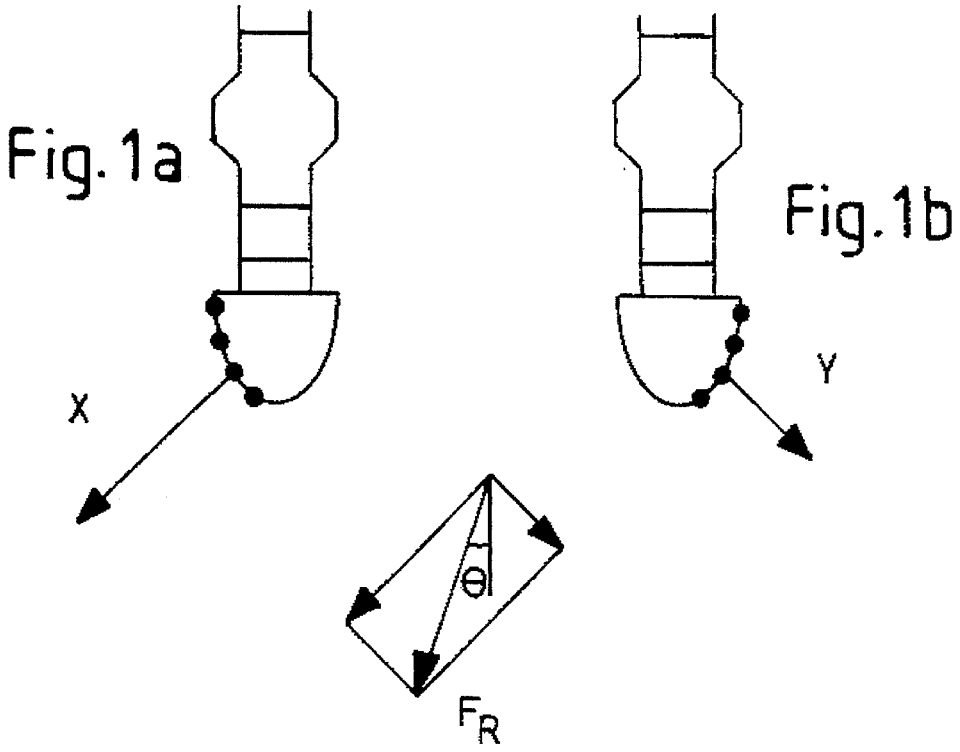
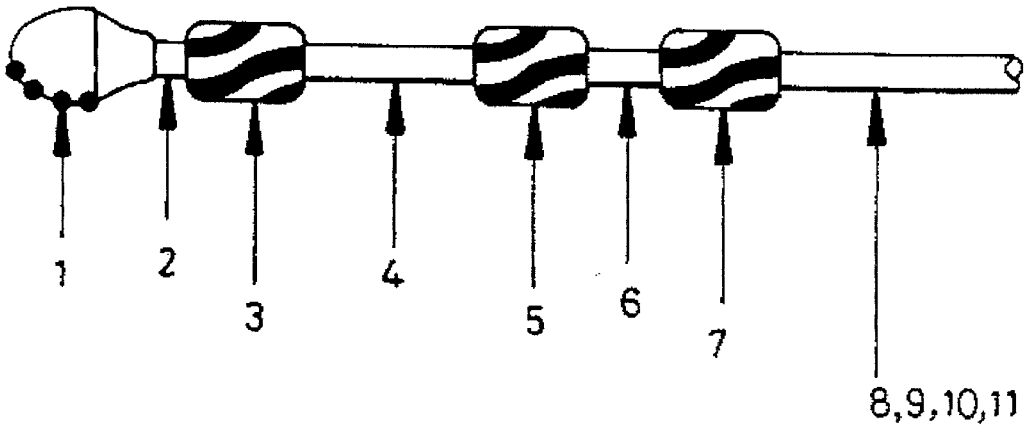
Fig. 2

BOTTOM HOLE ASSEMBLY

BACKGROUND OF THE INVENTION

1. Field of the Invention

The present invention relates to a bottom hole assembly (BHA) for use in directional rotary drilling.

2. Description of the Related Art

Current directional drilling practice is to drill the greatest portion of a deviated well using rotary bottom hole assemblies. A rotary assembly is designed to increase (build) or decrease (drop) the inclination in the vertical plane, and, to a lesser extent, to turn to the right or the left in the horizontal plane. However, the degree to which the rotary assembly will deviate cannot be accurately preset. Furthermore, even if a slight change in the deviation trajectory becomes necessary while drilling, the BHA needs to be pulled up to the surface and manually reconfigured. It is for these reasons that in sections of a well where a reliable, accurate, or continuous change in the rate of deviation is required, the rotary assembly is brought to the surface and a steerable assembly is put in its place. A steerable assembly is one which includes a downhole motor and a bent sub near to the bit. In such a case the BHA comprises a drill bit, a bent sub which angles the bit axis at around ½°–3° from the drillstring axis, and a downhole motor connected to the bit. The new path of the borehole is achieved by turning the drillstring until the bit is pointing in the desired direction due to the bent sub. This position can be found by means of instruments located in the BHA, such as accelerometers or magnetometers, which can determine the direction in which the bit is facing and transmit the information to the surface. Once the bit is oriented in the appropriate direction, it is rotated by means of the downhole motor, weight being applied to the bit from the surface in the usual manner but without rotation of the drillstring, and so is allowed to drill ahead in the desired direction. Once the trajectory of the borehole has deviated to the required degree, the drillstring is pulled from the well and the BHA replaced with a rotary BHA, and rotary drilling recommences to drill straight ahead or deviate in the conventional manner.

There are a number of problems when drilling with a BHA including a bent sub and downhole motor. When drilling is conducted without rotation using the downhole motor, the rate of penetration is greatly reduced. There is also a greater likelihood that the drillstring will become stock. Furthermore, use of a combination of rotary and steerable tools often requires a greater number of trips of the drillstring out of the hole to change or adjust BHA components; this combined with the slower rate of penetration, can seriously affect the rate of progress of a well and add to the overall cost, as can the cost of the BHA equipment used. For this reason, together with the problems outlined above, alternative methods of directional drilling have been sought. U.S. Pat. Nos. 4,597,455 and 4,732,223 describe a downhole adjustable sub which can provide either a bent or straight BHA according to requirements, the sub being activated by dropping a ball through the drillstring into the sub so as to activate a clutch mechanism. U.S. Pat. No. 4,739,843 describes a system in which an eccentric stabilizer which is prevented from rotating is used to create the deviation at the bit, and a flexible section of drill pipe allows a tight radius of curvature to be made by the bit while rotary drilling.

An alternative approach to directional rotary drilling is described in U.S. Pat. No. 4,995,465 and GB 2,246,151, in which either an asymmetric bit or a normal bit and bent sub combination is used in rotary drilling in conjunction with some means for creating pulses in the weight applied to the bit. By timing the weight on bit (WOB) pulses to coincide with a given rotary position of the bit, a deviation can be created.

The present invention resides in the realization that the BHA design can be optimized so as to maximize the deviation that can be effectively achieved with periodic modification of the cutting action of the bit in the borehole.

SUMMARY OF THE INVENTION

The present invention provides a bottom hole assembly (BHA) for connection to a drillstring for use in directing the path of a drill bit while rotary drilling, the BHA comprising: a drill bit arrangement; means for providing a modified cutting action of the bit in a predetermined portion of the hole during rotation according to the rotary position of the bit in the hole; and a stabilizer; the BHA being characterized in that a flexible member is incorporated into the end portions of the BHA in the vicinity of the drill bit.

By "flexible" is meant flexible relative to the main body of the BHA—typically the flexible member is a member made from a material having a lower Young's modulus than the BHA pipes' steel and/or a member with a smaller wall thickness than the remainder of the BHA. In the former case, a flexible member might be provided by an aluminum (or aluminum alloy) drill collar or a composite material drill collar. Alternatively or additionally, the wall thickness of the material from which the collar is formed can be made less than the remainder of the BHA.

Preferably the flexible member is interposed between the bit and the stabilizer, and most conveniently it is located immediately adjacent to the bit. Both the material and the dimensions of the flexible member can be selected to give the desired flexibility at or near the bit.

The means for providing a modified cutting action can be any means which modifies the cutting action at the bit such that, for a given rotation of the bit, the cutting action in one sector of the hole is different from that in the remainder of the hole. By persistently modifying the cutting action in one sector of the hole, either by increasing or decreasing the amount of cutting, the path of the bit can be caused to deviate. One technique that can be used is to provide an asymmetric drill-bit assembly together with means for varying the weight applied to the bit according to its rotary position in the hole. The asymmetric drill-bit assembly can comprise a symmetrical bit and a bent sub in the BHA, or a substantially straight BHA and a drill bit having cutters arranged in a non-radially symmetric pattern. Another technique is to provide means which change the flow of drilling fluid through the bit in a given sector of the hole such that the cutting action of the bit is changed. For example, the flow of drilling fluid through one part of the bit can be reduced or even stopped as that part of the bit passes the sector in which the cutting action is to be modified.

The flexible member is most preferably located between the stabilizer and the bit even if some or all of the means for producing the modified cutting action is located above the stabilizer. The dimensions and flexibility of the BHA below the stabilizer should be such that that portion will not sag to the extent that it contacts the borehole wall when the drillstring is inclined to vertical.

In a further embodiment of the invention the flexible member comprises an articulated member.

BRIEF DESCRIPTION OF THE DRAWINGS

The present invention will now be described, though by way of example only, with reference to the accompanying Drawings in which:

FIGS. 1*a* and 1*b* show schematic views of a BHA in different positions in the borehole, to illustrate the principle behind the present invention;

FIG. 2 shows a schematic side view of a further BHA according to the present invention;

DESCRIPTION OF THE PREFERRED EMBODIMENT

Figure 3:
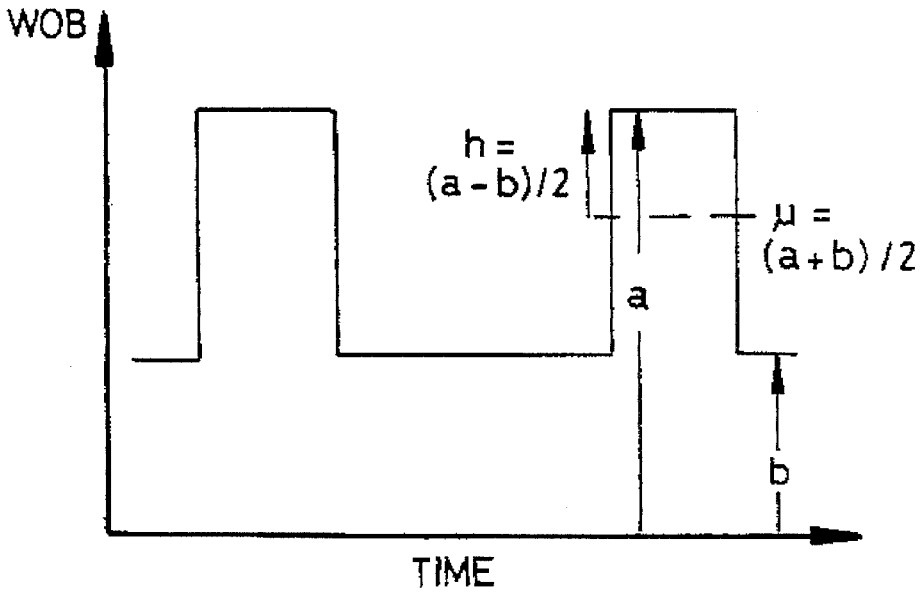
FIG. 3 shows a plot of one possible weight-on-bit against time profile for a BHA of the present invention.

The present invention provides a BHA which is suitable for a pulsed weight-on bit (WOB) rotary steerable drilling system (though other techniques for modifying the cutting action at the bit such as controlling the jetting of drilling fluid through the bit can also be used to much the same effect). In such a WOB system a radially asymmetric bit is provided having better cutting ability in one region of the bit than another. This radial asymmetry is combined with varying the WOB such that more weight is applied when the region of the bit having the best cutting ability is aligned with the desired direction for drilling and less when it is elsewhere. Thus, the bit preferentially cuts in the desired direction. This is summarized in FIGS. 1*a* and 1*b* (respectively pulse on and pulse off), in which the arrows X and Y indicate the penetration vectors with the WOB high (X) and low (Y). The resultant force vector $F_R$ is rotated relative to the axis of the bit by an amount θ dependent upon the magnitude of the WOB when the pulse is on and off and on the design of the bit.

The components of a BHA according to one embodiment of the invention are shown in FIG. 2 and defined in Table 1 below:

TABLE 1

| Component Number | Component | Length/ft | Outer Diameter/in | Inner Diameter/in | Blade Diameter/in |
|---|---|---|---|---|---|
| 1 | BIT | 1.93 | 8.500 | | |
| 2 | DC | A | B | 2.8130 | |
| 3 | SZR | 6.50 | 6.500 | 2.8125 | 8.500 |
| 4 | DC | 25.00 | 6.625 | 2.8125 | |
| 5 | SZR | 5.69 | 6.500 | 2.8125 | 8.500 |
| 6 | MWD | 37.15 | 6.750 | 2.8750 | |
| 7 | SZR | 5.69 | 6.500 | 2.8125 | 8.500 |
| 8 | DC | 57.67 | 6.500 | 2.7500 | |
| 9 | DC | 1.59 | 6.250 | 2.8750 | |
| 10 | DC | 30.70 | 6.250 | 2.8125 | |
| 11 | DP | 30.00 | 5.000 | 3.0000 | |

The component number is the position of that component in the BHA, numbering from the bit. In this preferred embodiment the BHA comprises an 8.5 in (22 cm) PDC bit 1 (BIT) which has been modified such that the cutting teeth have been removed from a 120° sector of the bit and replaced by non cutting supports. Connecting the bit to the remainder of the BHA is a flexible drill collar 2 (DC). In the Table, the length and outer diameter of the flexible drill collar 2 are given as A and B. These, together with the material from which the collar is formed, can be varied according to the desired properties of the BHA as will be described in further detail below. The next arrangement in the BHA is a first stabilizer 3 (SZR) of 8.5 in (22 cm) blade diameter. The BHA then comprises a drill collar 4 (DC), second stabilizer 5 (SCR), and MWD package 6 (MWD), third stabilizer 7 (SZR), three drill collar sections 8, 9, 10 (DC) of differing dimensions, and finally a section of drill pipe 11 (DP). In the following description, all of the components of the BHA will remain constant apart from the dimensions A and B and the material of the flexible drill collar 2.

The profile of the pulsing of WOB is summarized in FIG. 3, where WOB is plotted against time (for a constant rate of rotation, time corresponds to the angular position of the bit and in this case one pulse is applied per complete revolution). The magnitude of the angle θ (the change in the drilling direction at the bit) is dependent upon the ratio of the half amplitude h of the WOB pulse and the half WOB value μ. In FIG. 2, the base WOB is b, the pulse WOB is a, $$h = \frac{(a-b)}{2} \text{ and } \mu = \frac{(a+b)}{2}.$$

The effect of varying h/μ for a given BHA is that the higher the value of h/μ, the higher the magnitude θ of the deviation at the bit—and consequently the higher the deviation of the whole BHA. This is summarized in Table 2 below. The BHA to which the data relate comprises a 8.5 in (22 cm) bit, a 13' aluminum drill collar, an 8.25 in (21 cm) stabilizer, 33 ft (10 m) drill collar, a further 8.25 in (21 cm) stabilizer, drill collar and 8.5 in (22 cm) stabilizer.

TABLE 2

| h/μ | 20% | | | 40% | | |
|---|---|---|---|---|---|---|
| Half WOB (klbf) μ | 6 | 18 | 36 | 6 | 18 | 36 |
| Half pulse size (klbf) h | 1.2 | 3.6 | 7.2 | 2.4 | 7.2 | 14.4 |
| Drillstring deviation | Increase in build or drop in degrees/100 ft area unpulsed drilling | | | | | |
| 0° (vertical) | 1.05 | 3.28 | 5.86 | 2.14 | 6.60 | 12.70 |
| 45° | 1.12 | 3.21 | 6.07 | 2.24 | 6.47 | 12.47 |
| 90° (horizontal) | 1.13 | 3.24 | 6.12 | 2.26 | 6.54 | 12.69 |

As can be seen from Table 2, the increase in build or drop does vary depending on the inclination of the drillstring, but is generally similar for all inclinations. Unless otherwise stated, the data given herein relates to a drillstring of 45° inclination.

Figure 4:
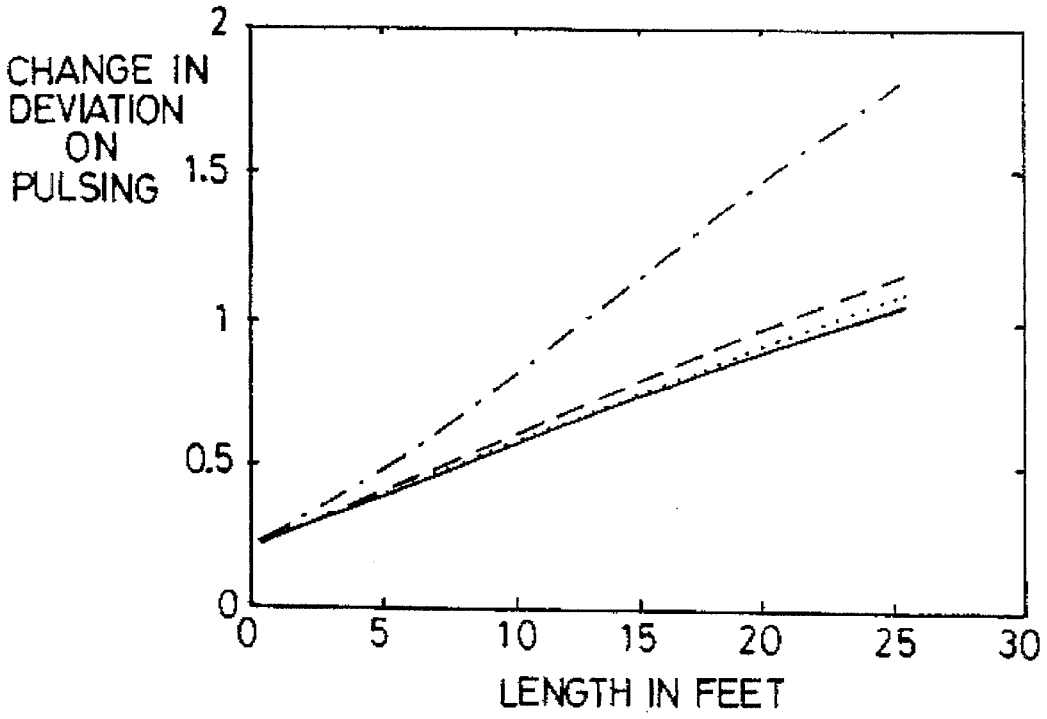
FIG. 4 shows a theoretical plot of the difference of unpulsed build rate vs. pulsed build rate for different BHA's according to the present invention.

The amount of deviation which can be produced for a given pulse (i.e., fixed pulse duration, h/μ etc. ) is dependent upon the amount that the flexible drill collar flexes in use. This can be varied either by maintaining the dimensions of the drill collar but using a material of differing flexibility, and/or by varying the dimensions of the drill collar, or both. FIG. 4 shows how the deviation on pulsing is dependent upon the nature of the flexible collar. The x-axis comprises the length of the flexible collar (A in Table 1), and the lower three lines represent the performance on pulsing WOB of steel drill collars of differing outer diameters (B in Table 1, bore of 3 in (7.5 cm) in all cases). The diameters used are 6.625 in (17 cm) (solid line), 6.25 in (16 cm) (dotted line) and 6.00 in (15 cm) (dot dash line). The uppermost line relates to a drill collar corresponding in dimensions to the lowermost line but made out of aluminum (Young's modulus 68.9 $GN/m^2$) rather than steel (Young's modulus 210 $GN/m^2$).

The flexible portion of the BHA, in the vicinity of the bit, may be incorporated into the flexible drill collar 2, which can have various lengths and dimensions, depending on design parameters well known in this field. Alternatively, a greater portion of the BHA may be made flexible, for example, including the drill collar 2, stabilizer 3 and drill collar 4, in accordance with the present invention.

What is claimed is:

1. A bottom hole assembly (BHA) for connection to a drillstring for directing the path of a borehole while rotary drilling, the BHA comprising:

a drill bit operatively connected to a first stabilizing means;

a flexible member at least partially interposed between the bit and the first stabilizing means; and means acting on the bit for causing a modified cutting action.

2. A BHA as claimed in claim 1, wherein the flexible member comprises a drill collar formed from a material having a lower Young's modulus than steel.

3. A BHA as claimed in claim 1 or 2, wherein the BHA further comprises at least one drill collar and wherein the flexible member comprises a drill collar of reduced wall thickness when compared to said at least one drill collar.

4. A BHA as claimed in claim 1 or 2, wherein the flexible member is fully interposed between the bit and the first stabilizing means, and is located immediately adjacent the bit.

5. A BHA as claimed in claim 3, wherein the flexible member is fully interposed between the bit and the first stabilizing means, and is located immediately adjacent the bit.

6. A BHA as claimed in claim 1 or 2, wherein the first stabilizing means is the lowermost of a series of two or more stabilizers.

7. A BHA as claimed in claim 4, wherein the first stabilizing means is the lowermost of a series of two or more stabilizers.

8. A BHA as claimed in claim 5, wherein the first stabilizing means is the lowermost of a series of two or more stabilizers.

9. A BHA as claimed in claim 6, wherein the first stabilizing means is the lowermost of a series of two or more stabilizers.

10. A BHA as claimed in claim 1 or 2, further comprising an asymmetric drill bit assembly, and wherein the means acting on the bit for causing a modified cutting action comprises means for causing pulses in the weight applied to the bit according to the rotary position of the bit in the borehole.

11. A BHA as claimed in claim 3, further comprising an asymmetric drill bit assembly, and wherein the means acting on the bit for causing a modified cutting action comprises means for causing pulses in the weight applied to the bit according to the rotary position of the bit in the borehole.

12. A BHA as claimed in claim 4, further comprising an asymmetric drill bit assembly, and wherein the means acting on the bit for causing a modified cutting action comprises means for causing pulses in the weight applied to the bit according to the rotary position of the bit in the borehole.

13. A BHA as claimed in claim 5, further comprising an asymmetric drill bit assembly, and wherein the means acting on the bit for causing a modified cutting action comprises means for causing pulses in the weight applied to the bit according to the rotary position of the bit in the borehole.

14. A BHA as claimed in claim 6, further comprising an asymmetric drill bit assembly, and wherein the means acting on the bit for causing a modified cutting action comprises means for causing pulses in the weight applied to the bit according to the rotary position of the bit in the borehole.

15. A BHA as claimed in claim 10, wherein the asymmetric drill bit assembly comprises a symmetric drill bit and a bent sub.

16. A BHA as claimed in claim 10, wherein the bit has an arc of modified cutting ability and the pulse is applied for a portion of rotation corresponding to said arc.

17. A BHA as claimed in claim 10, wherein the means for producing pulses in the weight on bit produces pulses having a ratio of h/μ of 20–50%, wherein $$h = \frac{(a-b)}{2} \text{ and } \mu = \frac{(a+b)}{2},$$

a being the total weight applied by the pulse and b being the weight applied without the pulse.

18. A BHA as claimed in claim 1 or 2, wherein the means acting on the bit for causing a modified cutting action comprises means for varying the flow of a drilling fluid through the bit in accordance with the position of the bit in the borehole.

19. A BHA as claimed in claim 3, wherein the means acting on the bit for causing a modified cutting action comprises means for varying the flow of a drilling fluid through the bit in accordance with the position of the bit in the borehole.

20. A BHA as claimed in claim 4, wherein the means acting on the bit for causing a modified cutting action comprises means for varying the flow of a drilling fluid through the bit in accordance with the position of the bit in the borehole.

21. A BHA as claimed in claim 10, wherein the asymmetric drill bit assembly comprises a bit having an asymmetric array of cutters thereon.

* * * * *